US008245724B2

(12) United States Patent
Kissel, Jr.

(10) Patent No.: US 8,245,724 B2
(45) Date of Patent: Aug. 21, 2012

(54) PNEUMATIC SYSTEM FOR RESIDENTIAL USE

(75) Inventor: Waldemar F. Kissel, Jr., Gainesville, FL (US)

(73) Assignee: WFK & Associates, LLC, Gainesville, FL (US)

( * ) Notice: Subject to any disclaimer, the term of this patent is extended or adjusted under 35 U.S.C. 154(b) by 1047 days.

(21) Appl. No.: 12/168,346

(22) Filed: Jul. 7, 2008

(65) Prior Publication Data

US 2009/0032126 A1 Feb. 5, 2009

Related U.S. Application Data

(60) Provisional application No. 60/948,333, filed on Jul. 6, 2007.

(51) Int. Cl.
*F16L 5/00* (2006.01)

(52) U.S. Cl. ..... 137/357; 137/565.23; 137/565.26; 137/597; 15/301; 60/407; 454/254

(58) Field of Classification Search ..... 137/357, 137/565.26, 597, 565.23, 565.01; 15/314, 15/312.1, 312.2, 301; 60/407, 411–412, 60/453–454; 454/254, 255, 256; 62/78, 62/237; 236/44 A See application file for complete search history.

(56) References Cited

U.S. PATENT DOCUMENTS

| | | | | |
|---|---|---|---|---|
| 1,048,477 | A * | 12/1912 | William | 406/117 |
| 1,676,969 | A * | 7/1928 | Sutton et al. | 209/502 |
| 2,877,313 | A * | 3/1959 | Stoicos | 200/61.6 |
| 3,314,098 | A * | 4/1967 | Carsey | 15/301 |
| 5,117,900 | A * | 6/1992 | Cox | 165/53 |
| 5,279,609 | A * | 1/1994 | Meckler | 236/49.3 |
| 5,360,374 | A * | 11/1994 | Wyon et al. | 454/306 |
| 6,318,113 | B1 * | 11/2001 | Levy et al. | 62/426 |
| 6,796,386 | B2 | 9/2004 | Izumisawa et al. | |
| 6,863,342 | B2 * | 3/2005 | Floyd, Jr. | 297/180.11 |
| 6,974,380 | B2 * | 12/2005 | Cui et al. | 454/229 |
| 7,028,785 | B2 | 4/2006 | Randa | |
| 7,089,833 | B2 | 8/2006 | Hamann et al. | |
| 7,328,575 | B2 | 2/2008 | Hedman | |
| 2003/0177777 | A1 * | 9/2003 | Brumett | 62/264 |
| 2006/0021375 | A1 * | 2/2006 | Wetzel et al. | 62/419 |
| 2006/0105697 | A1 * | 5/2006 | Aronstam et al. | 454/256 |
| 2007/0079467 | A1 * | 4/2007 | Cunningham | 15/314 |

FOREIGN PATENT DOCUMENTS

WO WO 2004104417 A1 * 12/2004

* cited by examiner

*Primary Examiner* — Craig Schneider
*Assistant Examiner* — David Colon Morales
(74) *Attorney, Agent, or Firm* — GrayRobinson, P.A.; Michael J. Colitz, III

(57) ABSTRACT

The present invention relates to a Pneumatic System that can be employed within the residential environment. The system includes both a section mode and a pressure mode. Both of these modes, in turn, have both a low and a high pressure range. A variety of applications are disclosed for use in conjunction with the various modes of the system. These various applications are described in greater detail hereinafter.

9 Claims, 14 Drawing Sheets

FIG. 2
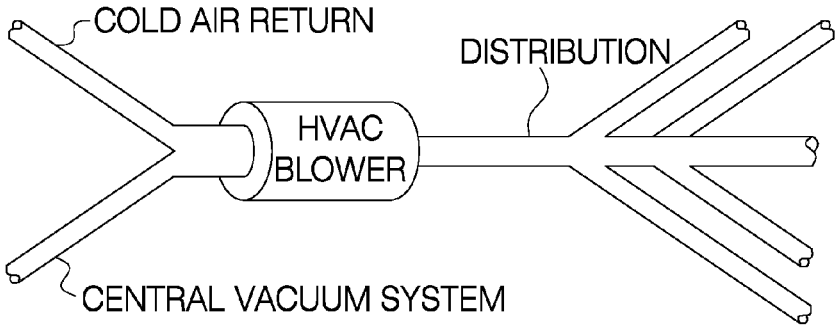
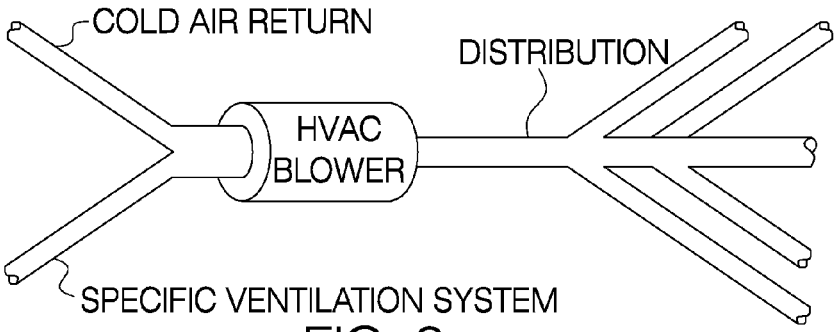
FIG. 3
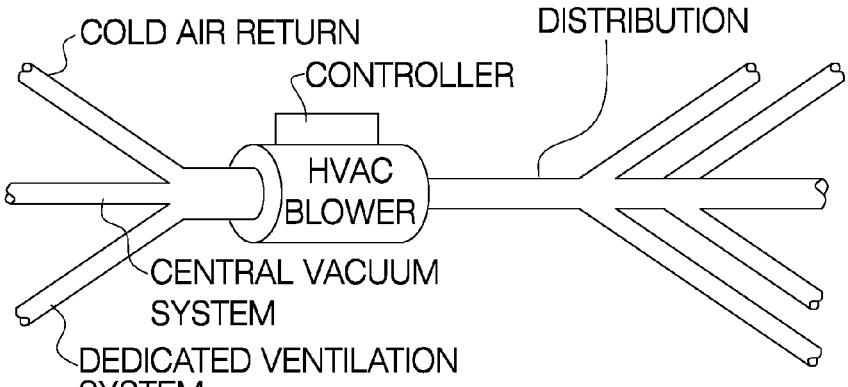
FIG. 4

FIG. 6
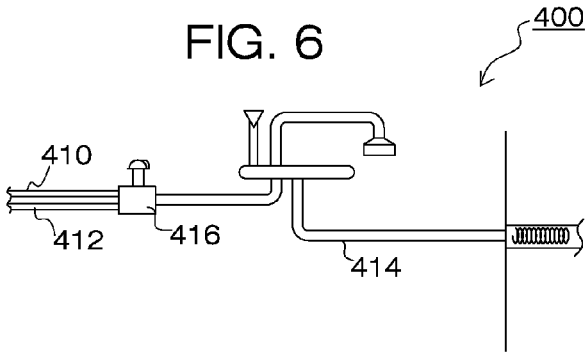
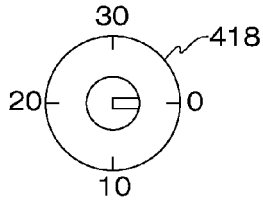
FIG. 6B
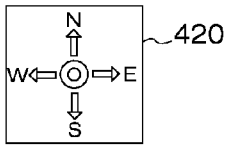
FIG. 6A
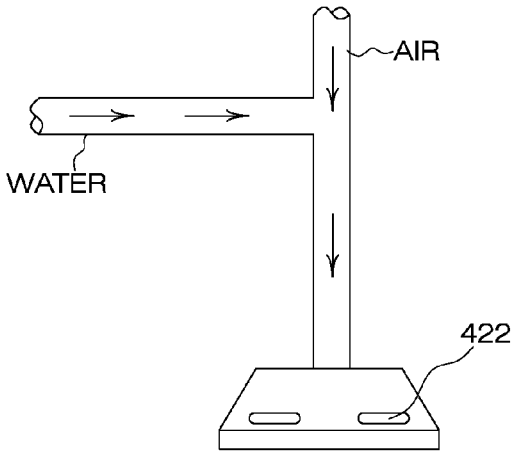
FIG. 7

FIG. 8
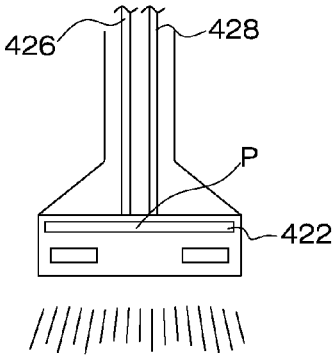
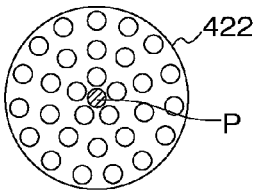
FIG. 8A
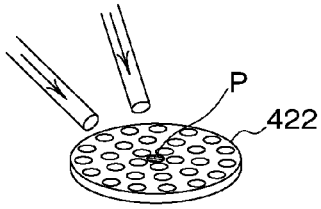
FIG. 8B
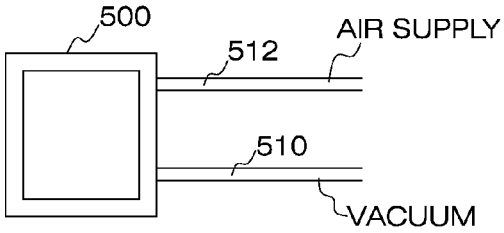
FIG. 9

FIG. 10
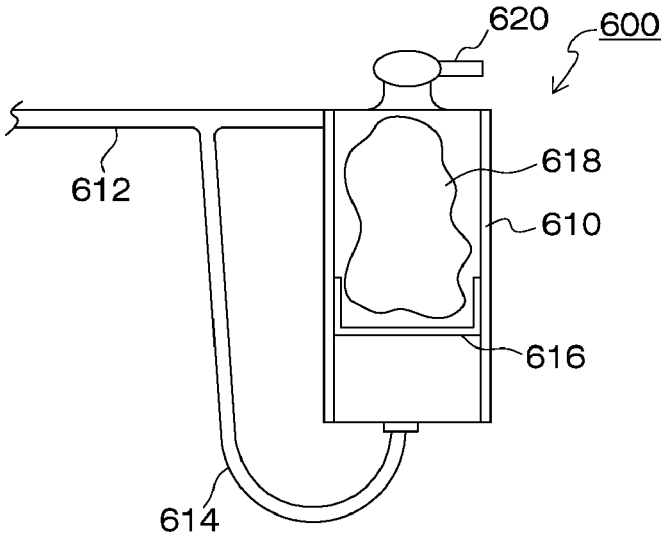
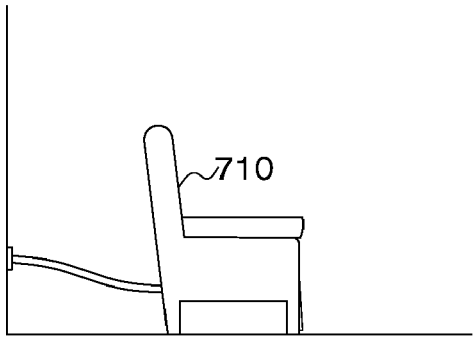
FIG. 11
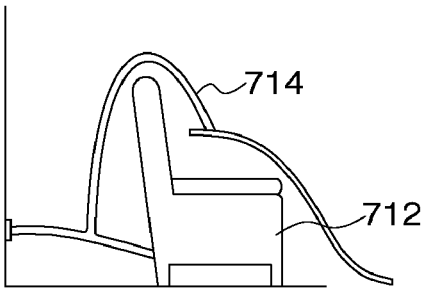
FIG. 12

FIG. 13
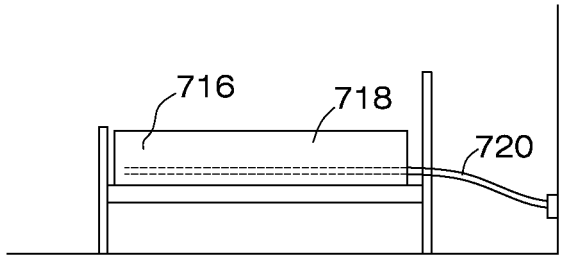
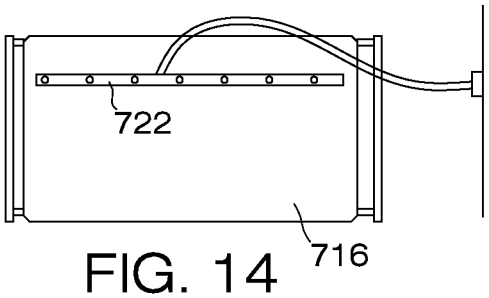
FIG. 14
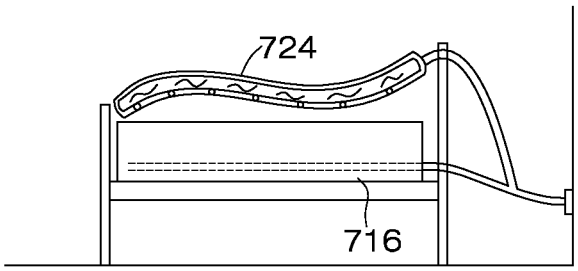
FIG. 15

FIG. 21
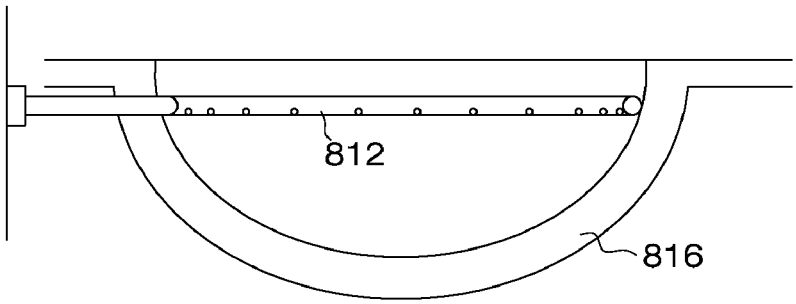
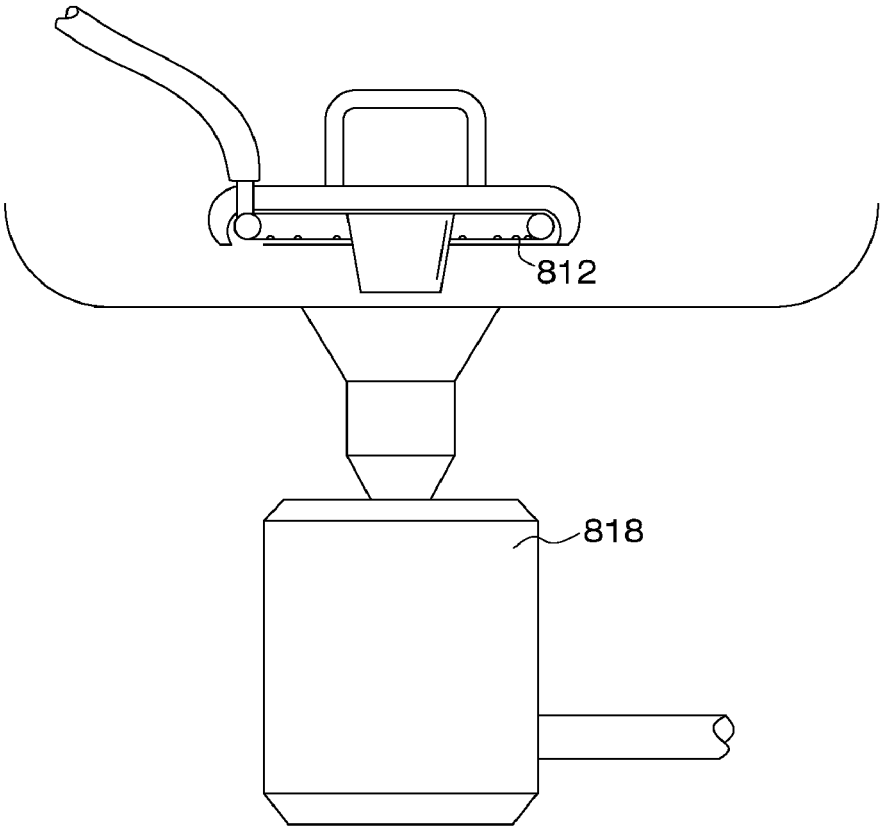
FIG. 22

FIG. 26
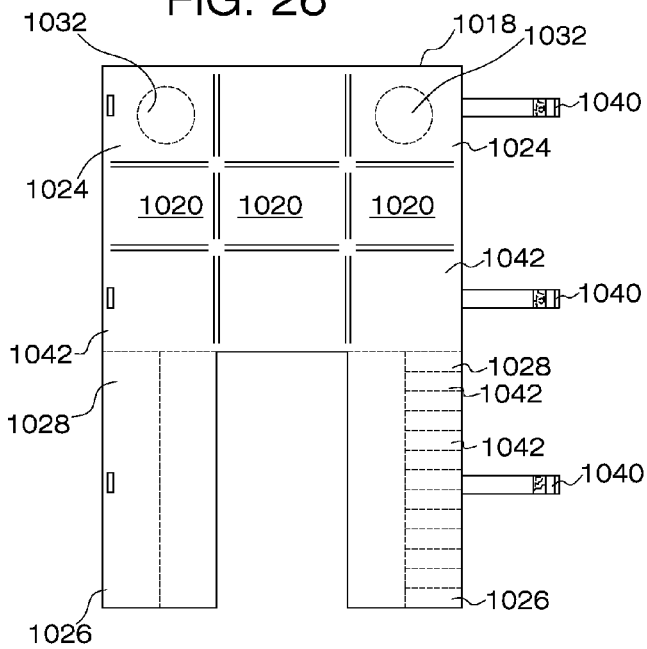
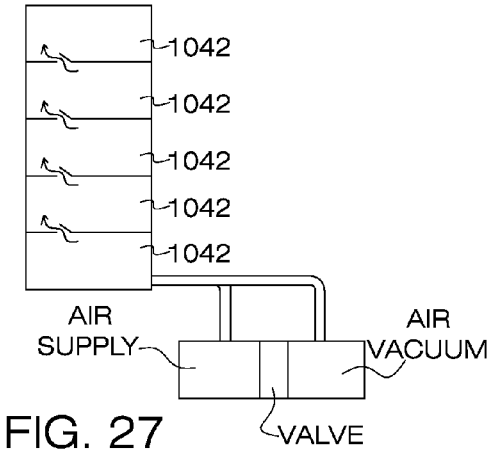
FIG. 27
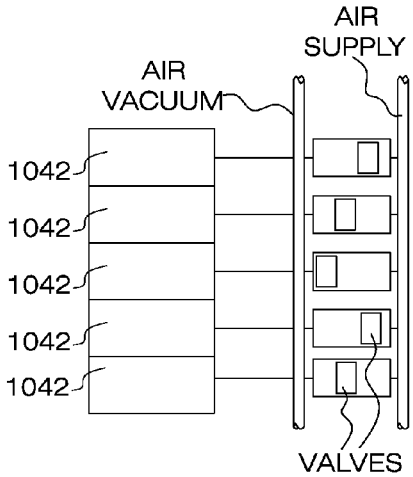
FIG. 27A

FIG. 29
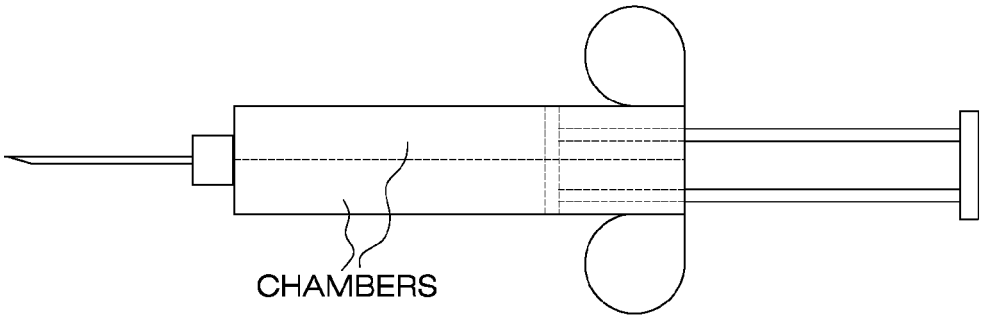
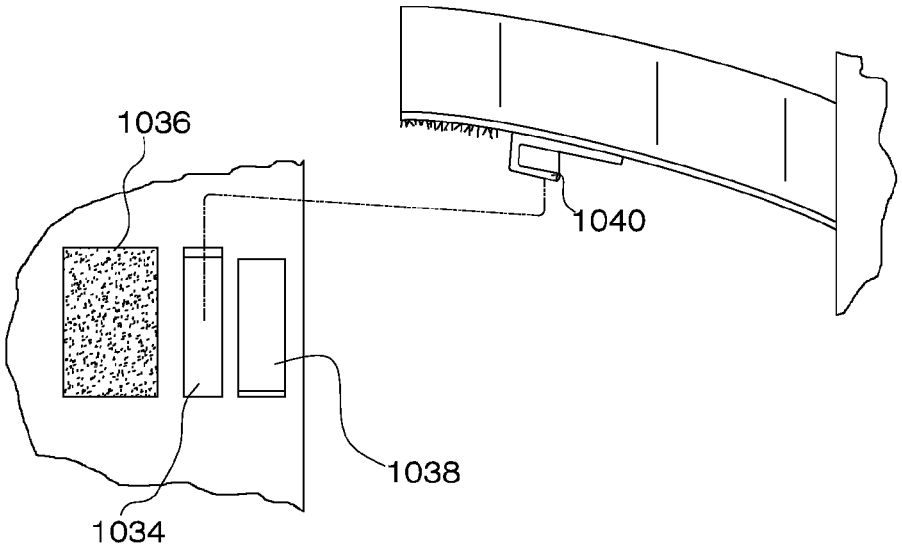
FIG. 30

PNEUMATIC SYSTEM FOR RESIDENTIAL USE

RELATED APPLICATION DATA

This application claims benefit of application Ser. No. 60/948,333 filed on Jul. 6, 2007 and entitled "A Pneumatic System for Residential Use." The contents of this co-pending application are fully incorporated herein by reference.

BACKGROUND OF THE INVENTION

1. Field of the Invention

This invention relates to a pneumatic system. More particularly, the present invention relates to a pneumatic system that has various residential applications.

2. Description of the Background Art

It is known to use pneumatics to power a variety of tools, such as wrenches and hammers. For instance, U.S. Pat. No. 7,328,575 discloses a device for the pneumatic operation of a tool. The device employs a fluid source, a compressor, and a number of heat exchangers in a closed pressure fluid circuit. The pressurized fluid is used to drive a series of tools.

Likewise, U.S. Pat. No. 7,089,833 discloses a device that uses compressed air for loosening and tightening fasteners that are located in hard to access areas. The device enables the user to switch sockets and thereby provide a wide variety of options to accommodate fasteners of varying shapes and sizes U.S. Pat. No. 7,028,785 discloses a pneumatic ground piercing tool. The tool includes a tail assembly including a tail nut and tail cap. The tail cap, in turn, includes a plurality of discharge ports for exhausting spent compressed air.

Finally, U.S. Pat. No. 6,796,386 discloses a pneumatic rotary tool that employs a plastic housing to reduce the weight of the tool. The tool further includes a torque selector which controls the amount of pressurized air allowed to enter the air motor. This controls the torque output of the motor. The user may adjust the torque selector to a number of set positions which correspond to discrete torque values.

Although the above referenced inventions each achieves their own individual objectives, none of them are directed to a residential pneumatic system wherein pressurized air is used to power a variety of household appliances. The present invention is directed at fulfilling a need in the art for such a residential pneumatic system.

SUMMARY OF THE INVENTION

It is therefore one of the objectives of this invention to provide a pneumatic system that finds application in or around a household residence.

It is also an object of this invention to integrate a pneumatic system for creating both pressure and suction in and around a home.

It is a further object of this invention to create an integrated pneumatic system that can power a wide variety of household appliances.

It is yet another object of this invention to integrate a pneumatic system with a heating ventilating and air conditioning system whereby air collected by the pneumatic system can be redistributed by the HVAC system.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIGS. 2-4 are a schematic views illustrating various systems for combining the pneumatic system of the present invention with an HVAC system.

FIGS. 6-8 illustrate a pneumatic hand drying application of the present invention.

FIG. 9 illustrates a vacuum clothes dryer application of the present invention.

FIG. 10 illustrates aerosol or spray can related applications of the present invention.

FIG. 11-17 illustrate various applications for the present invention that involve the creation of personal comfort zones.

FIG. 18-23 illustrate various applications for the present invention involving personal hygiene.

FIG. 25-30 illustrate various applications for the present invention involving medical applications.

Similar reference characters refer to similar parts throughout the several views of the drawings.

DETAILED DESCRIPTION OF THE PREFERRED EMBODIMENT

The present invention relates to a Pneumatic System that finds particular application within a residence. The first half of the system generates suction for use in providing ventilation and eliminating moisture. The second half of the system compresses the collected air and uses it in a variety of household applications. The collected air can also be re-circulated to the HVAC system of the residence. The various components of the present invention, and the manner in which they interrelate, are described in greater detail hereinafter.

Figure 1:
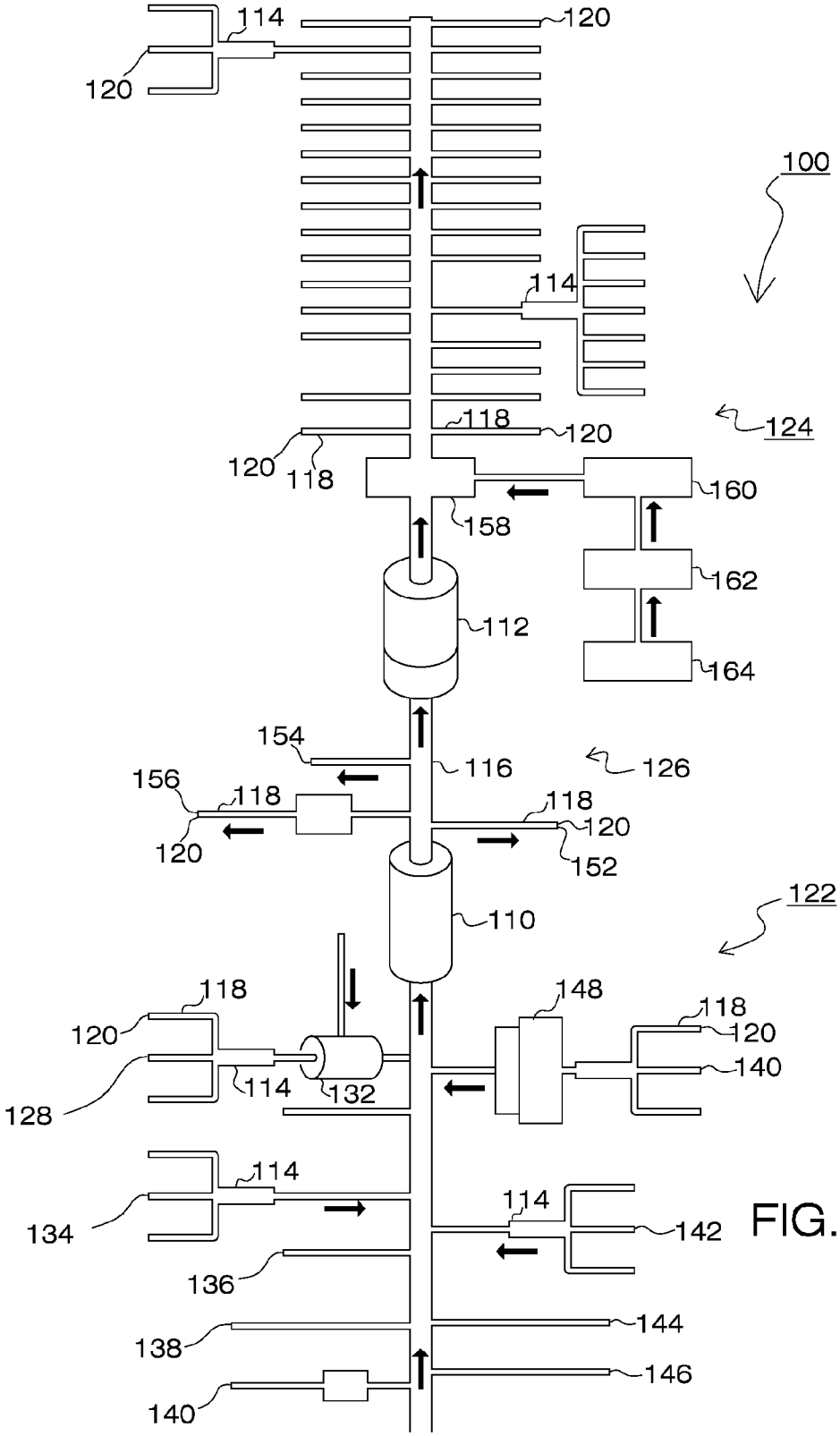
FIG. 1 is a schematic view of a primary embodiment of the residential pneumatic system of the present invention.

Primary Embodiment (FIG. 1)

With reference now to FIG. 1 of the application, the overall schematic of the system is provided. The pneumatic system 100 of the present invention includes both a suction pump 110 and a compressor 112 that are interconnected to various manifolds 114 and air ducts. The air ducts include a primary duct 116 and numerous secondary ducts 118 that are positioned throughout a residence. Air ducts 118 terminate at numerous ports 120 that located within the rooms of the residence.

In a first portion of the system 122, a variety of applications are included that take advantage of the suction created by pump 110. Thereafter, in a second portion of system 124, a variety of applications are provided that take advantage of the high pressure air provided by compressor 112. Additionally, between pump 110 and compressor 112, an intermediate portion 126 is provided that includes a number of low pressure applications.

With continuing reference to FIG. 1, the first portion 122 of the system is described. Here, suction pump 110 pulls air to create a vacuum at a number of different ports 120 throughout the residence. For example, some of these ports 120 can be wall outlets associated with a central vacuum system 128. Central vacuum system 128 preferably includes a vacuum filter tank 132. Other ports can be used as bathroom vent fans 134 for toilet and bathroom areas. Another port 136 can be used to pull warm air out of an attic. Still yet another port 138 can be used in conjunction with a pneumatic cardio pulmonary resuscitation unit as described more fully hereinafter.

Another port 140 draws moisture and lint from a clothes dryer and directs it to a collection bag. This may be the same collection bag used in connection with the central vacuum system. Still yet another port 142 can be used as the cold air return for a heating, ventilating, and air conditioning system ("HVAC"). Still additional ports 144 can be used for removing moisture from a closet. Ports 146 can be used for kitchen ventilation, such as the ventilation necessary above a range hood. This port may optionally include a grease filter and/or a fire and smoke sensors. If necessary, additional suction for the above referenced applications can be provided by a vacuum buffer tank and an associated vacuum pump 148.

Suction pump 110 then collects and dehumidifies the accumulated air. An electronic air filter may also be included to clean the air collected by the suction pump. Various outlet ports are included immediately adjacent the outlet of pump 110 for various low pressure applications. These applications include a general discharge port 152 that vents to the outside air. Another port 154 may discharge into the attic to drive out hot or cold air depending upon the season. An additional outlet port 156 can be used to redistribute the air to back into the HVAC system.

Thereafter, an additional supply of air from pump 110 is delivered to compressor 112 via primary duct 116. Compressor 112 pressurized the air for further downstream higher pressure applications. The preferred pressure is about 100 lbs. per square inch ("psi") but the use of other pressure levels is also within the scope of the present invention. The pressure and volume of air flowing through the system can be regulated depending upon the particular applications being employed. More specifically, pressurized air from compressor 112 can be collected within a pneumatic manifold. Air pressure from this manifold 158 can then be controlled via a computer 160, programmable logic circuit 162 and/or a sensor control 164.

The high pressure air created by compressor 112 can be used in any of a wide variety of applications, many of which are elaborated upon hereinafter. FIG. 1 illustrates a number of ports 120 within the second portion 124 of the system 100. These ports can be positioned at various locations in an around for residence to provide a convenient and useful source of pressurized air. The ports can also be used as a power source for a pneumatic tool or motor.

Some potential applications include: pressurizing aerosol cans; operating a garage door, porch door or double door; operating a door lock; operating a window covering; providing air for a hair dryer; dusting and cleaning; deck misting; operating a messaging device; tire inflation; a cardio pulmonary resuscitation unit; a wall mounted hand dryer; a lavatory facet hand dryer; toilet flushing and rinsing; a shower head sprayer; lawn irrigation; Jacuzzi nozzles; providing air to an outdoor spa; kitchen faucet rinsing; creating personalized comfort zones; lawn sprinklers; car washing; paint spraying.

Combining Pneumatics and HVAC (FIGS. 2-4)

FIG. 2-4 illustrates combining an HVAC system with a central vacuum system to create synchronous system of shared parts in a residential pneumatic system. In FIG. 3, air from a specific ventilation system (i.e. bathroom ventilation fans, kitchen hood vents, clothes dryer vents, and/or moisture removal vents) along with a cold air return are routed to an HVAC blower intake. The output of the blower is then delivered to one or more outlet ports within the residence. In FIG. 2, the input to the HVAC blower is provided by the output from the central vacuum system. Again, the output from the HVAC blower is routed to one or more outlet ports along a distribution route.

The system can also be combined into a more complex residential pneumatic system as illustrated in FIG. 4. FIG. 4 illustrates multiple inputs to the HVAC blower, including air from a dedicated ventilation system, air from a central vacuum and air from a cold air return. This system results in the need for a controller for regulating the input from the return, vacuum and dedicated ventilation system.

Alternative Embodiment (FIG. 3)

Figure 5:
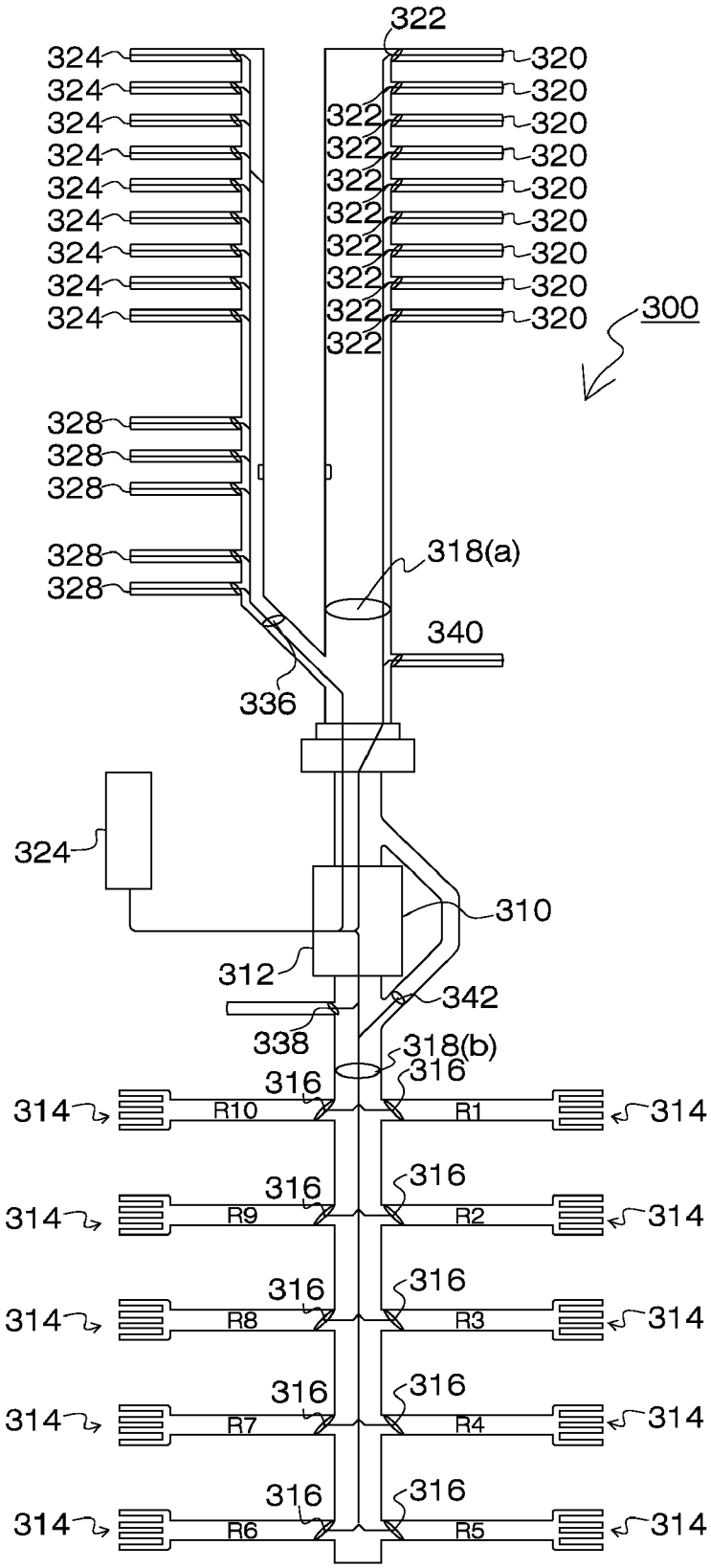
FIG. 5 is a schematic view of an alternative embodiment of the residential pneumatic system of the present invention.

A specific alternative embodiment of the present invention is depicted in FIG. 5. This embodiment dispenses with the need for a separate compressor and pump. Namely, this embodiment utilizes a single electric motor 310 to provide both suction for a central vacuum port 312 and air for the blower of an HVAC system.

With continuing reference to FIG. 5, the various rooms within the residence are indicated by R1-R10. More specifically, R1 corresponds to a bathroom; R2-R4 correspond to bedrooms; R6 to a living room; R7 to a utility room; R8 to a family room; R9 to a bathroom and R10 to a dining room. Air is selectively delivered to these rooms via air supply grills 314. Air flow into individual rooms can be controlled by supply dampers 316. Each of the rooms also includes a corresponding return 320 for the purpose of re-circulating air. Air flow from each return is controlled by a return damper 322.

The system 300 also includes a number other ports for use with a central vacuum system. Each of these ports likewise includes a control damper 326. A series of vents 328 can also be included for a dryer, bathroom fan, bathroom, shower and kitchen hood. Airflow from both the returns 320, central vacuum ports 324 and vents 328 is routed to a dehumidifier and a hot/cold air exchange 332.

In use, when residents want air conditioning in bedrooms R2-R4, for example, the corresponding supply dampers 316 are all opened and the supply dampers 316 associated with all other rooms R1 and R5-R10 are closed. At the same time major system dampers 318(*a*) and 318(*b*) within the main supply duct are opened. The return dampers 322 that correspond to bedrooms R2-R4 are open and all other cold air return dampers 322 are closed. All other dampers in the system are closed. If a bath vent fan 328 is needed the damper for that bathroom opens. Exhaust air will be drawn out.

In the daytime cold air supply dampers 316 for the living areas (R5, R6, R7, R8, R9) will be open and the air supply dampers 316 for the bedroom and dinning room (R2-R4 and R10) are closed. The return dampers 322 for the living areas (R5, R6, R7, R8, R9) are likewise opened and the return dampers 322 for the bedrooms and dinning rooms (R2-R4 and R10) are closed.

When a vacuum base is plugged into any one of the central vacuum inlets 324 a low voltage signal is sent back to a controller 324 which, in turn, turns on a motor associated with the vacuum. The cold air return major damper 318 also closes. The central vacuum master damper 336 also opens. The master HVAC air supply damper 338 may be open or closed depending on the way the system is programmed. If the master HVAC damper is closed then the damper 338 to the outside air will be open.

If weather outside is nice and outside air is wanted in the house then the master cold air return damper 318(*a*) will close. The master cold air return damper 340 will open and any individual room supply dampers 316 may be opened.

With continuing reference to FIG. 5, when the electric clothes dryer is turned on, system 300 will open the corresponding dryer vent damper 328. All other vent dampeners 328 will be closed. Additionally, the master cold air return damper 318(*a*) and outside air supply damper 340 will be closed. Damper 338 can be opened to allow the dryer to vent to the outside air. If it is a cold day, system 30 could open the master air supply damper 318(*a*) and close outside damper 338 to keep the warm dryer air inside.

Finally, FIG. 5 also illustrates a reverse flow damper 342. This damper is used to divert high pressure air back into the filters to force accumulated lint and settlings into the vacuum dirt bag. This has the effect of cleaning the filter associated with motor 310. In order to accomplish this reverse flow cleaning, dampers 318(*b*), 318(*a*), 340, 336 and 338 are closed. This cycle can be used to make the central vacuum self cleaning.

Specific Applications for the Pneumatic System

As noted more fully hereinafter, there are a wide variety of applications for the system of the present invention. Some of these applications include: a wall mount hand dryer, a lavatory faucet hand dryer, toilet flushing and rinsing, a shower head spray, car washing, lawn sprinklers, whirlpool tubs with air, environmental improved aerosol, garage door operator, pocket door operator, double door operator, door lock, widow cover operator, pneumatic cardio pulmonary resuscitation attendant, dishwasher, trash compactor, CPAP head mask, CPAP, hair dryer, housing cleaning/dusting, deck misting, kitchen faucets for rinsing dishware, arms/legs/foot/hand compression massage for circulation, pressurized irrigation system or a system for creating personalized comfort zones.

Water Faucet with Pneumatic Hand Dryer (FIGS. 6-8)

One application of residential pneumatics is a pneumatic hand dryer as illustrated in FIGS. 6-8. Such a pneumatic hand dryer would take the place of electric powered hot air hand driers wherein a button is pushed and air starts blowing and becomes warmer as it heats up. The primary disadvantage of the prior art is the low pressure of the air. As a result, it takes too long to dry the hands. If the air pressure is increased significantly in prior art systems it becomes a hazard to someone who may try to look into the air blower while it is on.

If a home or business has a residential pneumatic system in accordance with the present invention, it could have a hand dryer 400 as shown in FIG. 6. Item 410 is the hot water supply. Item 412 is the cold water supply. Item 414 is the compressed air supply. Item 416 is a valve for mixing hot and cold water. The base of the valve has a numerical index and the handle 418 has a pointer on it so the preferred mix of hot and cold water can be set to a reference index. The mixer can be left at a particular setting or turned to select a temperature before washing the hands. Item 420 is another mixer valve with a vertical four way handle. When the handle is pushed to the left (toward W) the water flow increases. When the handle is pushed back (toward N) the water and air pressure are increased in flow and pressure as they are mixed in the valve. In this position a smaller amount of water will suffice. When the handle 420 is pushed to the right (toward E) only a concentrated air stream at a strong pressure will come out. No water is dispensed at this setting. The pressure will be enough to immediately blow the water off the skin rather than take the time to evaporate it. If the handle 420 is pulled forward (toward S) the valve opens another air supply and sends additional air through another faucet outlet that surrounds the smaller original outlet. The additional air may come out at a lesser air pressure. Both a concentrated air pressure and a more diffused air pressure would be dispensed simultaneously. Optionally a heater coil could warm the air.

The end of the faucet would have slits 422 around the sides so that if the other outlets become blocked the high pressure air will dispense via slits 422.

There are two suggested ways for mixing the water and air. Shown in FIG. 7 is the pitot tube principle. The water is fed in from the side. The higher pressure air comes down and sucks the water into the stream. The embodiment shown in FIG. 8 is a forced water and mixer valve.

A small disk 422 has multiple small holes drilled through it. These holes can be drilled straight, inward, outward, backward or forward. Also there can be of various size openings, shapes and numbers. It all depends on the desired effect. The disc rotates about a center axis (P).

The disc is rotated very fast by the force of the water and air pressing against it. First the water from pipe 426 is forced into the holes. Then as disc 422 rotates, the air from pipe 428 pressurizes the flow of the water and forces the water out with considerable force.

It is understood that this concept of converting conventional plumbing faucets from releasing only water into fixtures that can deliver water, water and air mixed, and air only can apply to fixed shower heads, body sprays, kitchen sinks, kitchen sprays, and sprays for washing cars. Sprays for hair washing and hair drying is another possibility.

In all of these applications the mixing of water and air pressure will increase the effectiveness of the washing and rinsing process while conserving the amount of water actually needed. It is understood that another handle could be provided for application of liquid soaps and detergents if desired. The dry high pressure phase of the faucet supply can more effectively dry hands, dishes, rinse sinks, dry cars, apply car wax and dry hair.

Thus, this embodiment features a valve and faucet system that dispenses water, water and air mixed and pressurized air only for washing and drying in multiple applications including but not limited to hand washing, teeth cleaning, and shaving at lavatory sinks, dish washing and skillet cleaning and rising at a kitchen sink, water and air for shower, and for car washing, waxing and drying.

The invention also relates to a method of using warm pressurized air for drying hands using plumbing faucets that conventionally deliver only water. The invention also relates to the foregoing wherein slits or side openings are positioned near the outlet of the described fixtures to minimize inadvertent injury from high pressure air.

The invention further relates to a hot and cold water temperature pre-mixer valve with an index. A water and air mixer valve allows water, water, and air, air only, or air at two pressures and volumes to all flow from the same lavatory sink faucet. Pushing the handle to the left or back provides water or water and air for washing hands. Pushing the handle to the right or forward provides air for drying hands. The invention also relates to a single faucet outlet that dispenses water for washing and air for drying through the same outlet. This high air pressure is safer because the faucet is far enough down to the sink that eyes, mouth, or nose cannot be placed in front of it.

Vacuum Clothes Dryer (FIG. 9)

In this component of the residential pneumatic system a vacuum together with optional moderate heating and optional tumbling action is used to dry clothing that is too delicate to dry at normal high dryer temperatures but that otherwise takes too long to dry at ambient temperatures.

In FIG. 9 the air pressure inside the clothes dryer 500 is drawn down by suction pipe 510. As the air pressure drops, the boiling point of the water in the clothes drops and the water rapidly vaporizes.

However, if only a stagnant vacuum is applied the vapor cannot continue to evaporate and the low pressure air remaining inside the dryer will become saturated. To offset this problem high pressure compressed air will be supplied into the partial vacuum chamber at a controlled rate via pipe 512. It may be less than, equal to or greater than the rate at which air is removed by the vacuum pipe 510. The incoming air may be heated. As the compressed air enters the dryer it will expand, pick up more of the moisture and exhaust through the vacuum line 510. When the moisture sensor shows the clothing is dry dryer 500 will shut off.

To further accelerate the drying process without causing harm to delicate fabrics the vacuum drying can be supplemented with microwaves and/or infrared waves to heat the water in the clothes to a low temperature and low pressure vaporization point.

A vacuum buffer tank may be installed inline between the vacuum pump and the vacuum dryer so that when the manifold valve is opened the air pressure in the dryer is dropped rapidly at the very beginning of a drying cycle.

The vacuum dryer should dry clothing faster and gentler than a conventional dryer.

Aerosol & Spray Cans (FIG. 10)

Another application for the residential pneumatic system of the present invention relates to aerosol spray cans as noted in FIG. 10. Presently, aerosol cans are used for hair spray, deodorant, room freshener, spray on tans, sun screen, shaving cream, and other applications.

An aerosol can is built to last. Hold a can of hair spray. Notice how heavy it is. The sheet metal in a can is tougher than the sheet metal on most cars. The can has taken more engineering and cost than the product it delivers. It is the delivery process that adds the most value to the product. Spraying on a product clearly has advantages. The problem is that most of the cost comes as a result of the product packaging. After the product is used up the packing has no value but disposing of it is a problem. The package contains chemicals that may contaminate the environment, can be explosive and the container may be around in a landfill for the next 100 years.

If a home already has a residential pneumatic system it can be used to replace the conventional aerosol can method of product delivery since most of these products are used at the bathroom sink. FIG. 10 illustrates an aerosol spray can 600 in accordance with the invention. The can includes an 8 ounce plastic container 610. However, it will be appreciated that other sized containers will also suffice. An air hose 612 is also included that is adapted to be plugged into a port for accessing the compressed air created by the pneumatic system. An additional tube 614 is used to feed compressed air to the bottom of container 610. A cup like cylinder 616 is used to allow the air pressure to exert pressure on the bottom of a collapsible container 618 containing the product to be dispensed. The air pressure forces the product into a spray nozzle 620. Spray from nozzle 620 diverts air from the air supply 612 and turns the product into a fine aerosol mist. Once all the product is used, the empty container 618 is easily removed and replaced. There is no toxic gas released into the air. There is no difficulty in the disposing of the can, and the products should cost much less.

It should be noted that for some products the contents might be poured into the container, such as a liquid soap dispenser application, and pressurized air could be injected directly into the cans.

The system 600 can be used with a variety of products, for cleaning and or hygiene, such as creams, gels, and toothpastes. Depending on the product being dispensed, the cylinder 616 may or may not be needed.

Personalized Comfort Zones (FIGS. 11-17)

Still yet another application of residential pneumatic systems relates to manner of crating personalized comfort zones as illustrated in FIGS. 11-17. It is a waste of energy to heat or cool an entire house, or area of space to have a comfortable indoor climate. Often, the use of area air conditioning does not do an adequate job.

When a house is equipped with a central pneumatic system there are alternatives. In this centralized system the HVAC uses two inch diameter pipes although other sized pipes will suffice, to deliver heated or cooled air at high velocity and higher pressure than a conventional large sheet metal duct system. This is the central house HVAC system.

In this invention, hoses are plugged into a wall outlet to deliver a volume of high pressure heated or cooled air. This hose can feed air into a specifically modified lounge chair, sofa, or recliner 710, as noted FIG. 11. This heated or cooled air then is experienced more directly by the person occupying this furniture. A blanket can be used to keep the air entrapped around the person using the furniture.

This heating and cooling technique can be used outside in an appropriately modified chair 712 as shown in FIG. 12. This chair uses a blanket 714 or covering that is likewise inflated by the source of pressurized heated or cooled air. In very hot weather a person could enjoy sitting outside and being quite cool in the lounge chair 712. Or in very cold weather a person could enjoy being outside with a pet or experiencing a snowy outdoors while still being comfortably warm.

In another similar application involves a bed 716. In one approach the mattress 718 itself has small air supply distributed inside. A hose 720 is coupled at one end to the mattress and at the other end to a supply of cool or warm air, FIG. 13. Another approach is an air bar 722 as noted in FIG. 14. This bar 722 has several small holes along one side. One end of the bar 722 is plugged into a wall air supply. Bar 722 can be placed anywhere in bed 716 under the covers. At the bottom it could cool the entire bed. At one side of the bed it could cool only one individual on that side of the bed only.

Another method is to make a plush comforter 724 as noted in FIG. 15. A hose from the wall air supply feeds heated or cooled air into the comforter 724. The comforter (blanket or sheet) inflates on the inside. Its entire surface cools or heats.

By placing a rather impervious cover over the top of it the entire bed inside could be much cooler or warmer than the room itself. This can also be applied to fitted sheets as well or in addition.

This could provide considerable energy saving. When it is 95 degrees F. outside many people would set the temperature at 70 degrees F. to 78 degrees F. But using personalized climate controlled bed linens would allow someone to set the temperate at 85 degrees F. to 90 degrees F. during the night and still be comfortable 70 degrees to 75 degrees F. in the bed.

Figure 16:
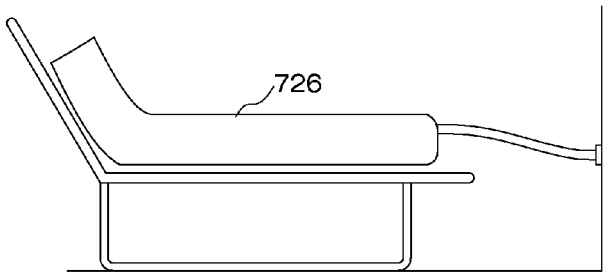
Figure 17:
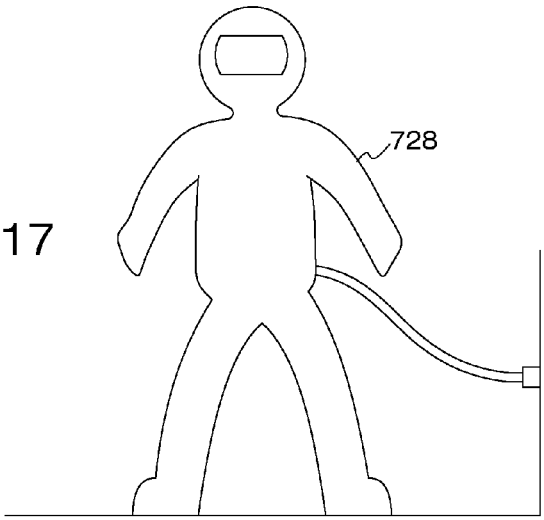
Figure 18:
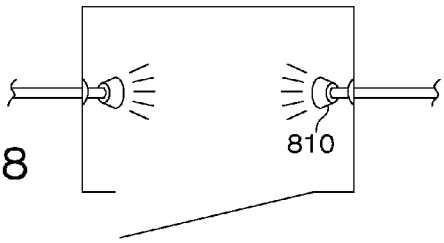

For the outdoorsman, a heated or cooled sleeping bag 726 could be outfitted with an air supply provided from an outdoor wall plug as noted in FIG. 16. This would allow a person to enjoy reclining outdoors, reading and getting fresh air and still be comfortable whether it is cold or hot outside. Alternatively, a complete set of wearing apparel 728 as noted in FIG. 17 for mobility could be created if someone wanted to be cooler or warmer than the ambient environment.

Personal Hygiene Applications (FIGS. 18-23)

Another application for residential pneumatic system relates to improve sanitation, such as preventing the growth of mold and mildew in shower stalls or toilets. Shower stalls with tile sides and glass tend to develop mold on the sides. A current solution is to keep a can of anti mold chemical in the shower and spray it after taking a shower. The problem with this is remembering to do the spraying. Spray bottles get empty. It is not very thorough, and the occupant has to inhale and come in contact with the spray.

In the residential pneumatic system a central reservoir of spray can be stored. Each time after the shower is used, or during the night, if the shower was used, a warning voice would announce that an anti mold spray was to be released, a low tone would sound, and then a high pressure chemical mist is released into the shower. As a mist it will spread out to all surfaces in the shower area, note FIG. 18. The cleaning solution would be provided from a dedicated shower head 810.

This can be applied to all showers, tubs, and wet areas of the house. The residential pneumatic system is also a good way to release ions into the air during the night in various parts of the house to fight ambient molds, toxins and germs.

Figure 19:
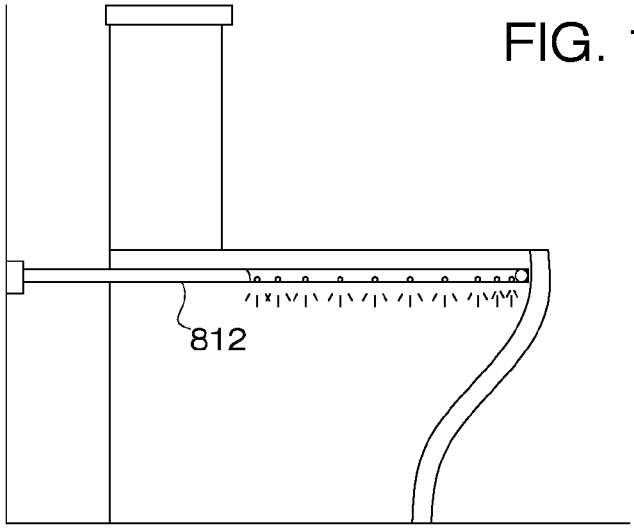

Toilet bowls require regular periodic cleaning with caustic and toxic chemicals. Also toilet lids and seats do not seal to the bowl very effectively. One solution is shown in FIG. 19. Here, a perforated ring tube 812 around the top of the toilet bowl can periodically sanitize the toilet during the night. The system would flush the toilet and evacuate all water from the bowl. Then a flow of sanitizing chemicals would be released along the sides of the toilet bowl and into the bottom. This would sit there for some time as programmed, perhaps 45 minutes.

Similar cleaning could be achieved relative to a sink or garbage disposal. Namely, as noted in FIG. 21, an apertured tube 812 could be provided about the periphery of a sink 816. Cleaning fluid could then be dispensed, with the assistance from residential pneumatics, to clean the sink. Likewise, in FIG. 22, an apertured tube 812 can likewise be provided about the periphery of a conventional garbage disposal 818. This would facilitate the cleaning of food particles from within the disposal via cleaning fluids delivered from tube 812.

Figure 20A:
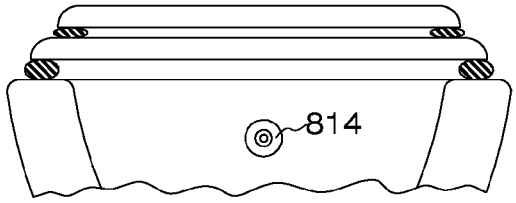
Figure 20:
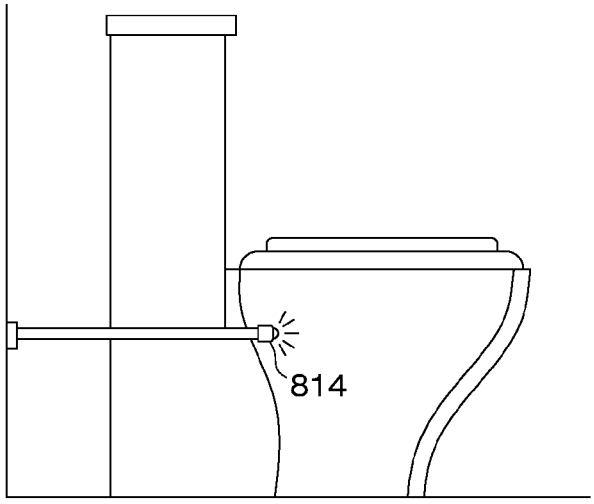

Another embodiment is disclosed in FIG. 20. Here, toilet seat and toilet lid would be lowered onto the bowl. These would be re-contoured so the toilet seat and lid form an air tight seal over the toilet bowl. The toilet lid would be locked into place. There would be a spray nozzle 814 at the back of the toilet bowl that would release a powerful cleaning agent mist into the toilet bowl. This would sanitize all surfaces including the seat at top. When the cleansing was finished it would then release a water rinse to remove the cleaning agent. Finally the same nozzle would release a stream of drying air for perhaps 30 minutes. When all done, the toilet lid would be unlocked for use.

Figure 23:
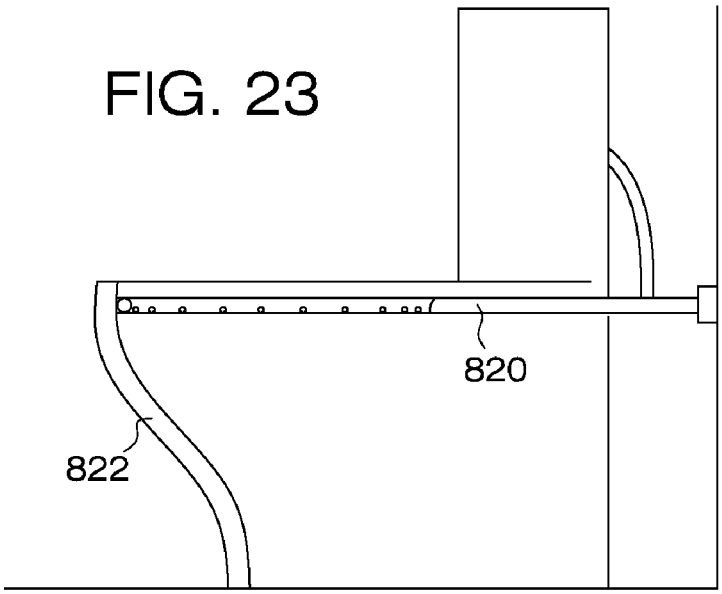

Still yet another application for Residential Pneumatic Systems relates to a pneumatically powered toilet as noted in FIG. 23. Water saving toilets, mandated by federal law, having difficulty flushing properly and often get stopped up. In commercial applications there are toilets that use air pressure to flush toilets. However, these are isolated systems too expensive for the home.

In this invention, pressurized air is used in two ways to improve the flushing ability of the conventional toilet. In FIG. 23 the water tank is modified so it can hold pressurized air in the tank. In addition, there are small water jets placed around the upper rim of the toilet bowl via tubing 820.

When the toilet is flushed the water in the tank is forced at high pressure through the water jets in tubing 820 where additional high pressure air from the residential pneumatic system forces the swirling water against the sides of the bowl 822 so the bowl is cleaned and the contents flushed with a mixture of air and water.

Figure 24:
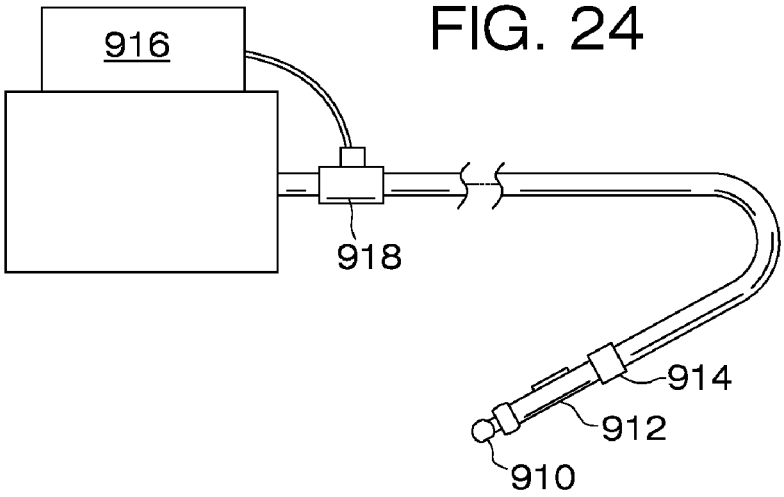
FIG. 24 illustrates a particular application for the present invention involving tire inflation.

Automatic Tire Pressure Inflation Gauge (FIG. 24)

The next embodiment concerns using the residential pneumatic system to automatically fill tires. In FIG. 24 the air nozzle 910 that goes over the tire stem is shown. Next to it is the tire pressure measurement chamber 912. There are no valves between this chamber 912 or the internal tire pressure so this chamber is exactly the same as the internal tire pressure. Attached to this is an electronic pressure gauge to very precisely measure the tire pressure. This information is sent back to a controller 916 through a low voltage wire attached to the air hose. When the air nozzle 910 is placed on the tire stem the chamber fills 912 with air. Controller 916 gets an accurate beginning tire pressure. If there is a substantial difference between actual tire pressure and recommended tire pressure controller 916 directs a solenoid controlled valve 918 to open up the valve enough to bring the tire pressure up rapidly. As the actual tire pressure readings get closer to recommended pressure the air valve 918 is slowly closed.

As measured pressure converges to recommended pressure the air flow is decreased further. The air valve 918 closes as the two pressure becomes the same.

If by chance the internal tire pressure exceeds the recommended tire pressure then the controller, instead of turning on the compressed air supply, would open a pressure release valve to allow pressure to flow out of the tire.

This invention is intended for use at gas stations, car washes, mechanic garages or other such places where vehicles accumulate.

In the present state of the art a motorist can check tire pressure with a separate gauge that is not calibrated into a well defined readable scale. Then air is blown into the tire for a few seconds, then checked with the gauge. It is not a precise process. Furthermore, most motorists would not be able to adjust the tire pressure recommendation to compensate for conditions immediately preceding tire inflation.

The invention described herein is another function that can be added to the already lengthy list of services that can be provided by the residential pneumatic system of the present invention.

With a residential pneumatic system the process just described can be accomplished at home with some modifications. The car is presumed to be parked in the garage. All the tire inflating information for each family vehicle is in the system. A high pressure hose is connected into a wall mount air supply. The other end has an air nozzle. All the drive has to do is indicate at the outlet which vehicle is being inflated and then place the nozzle over the tire aire stem. Do this to each tire.

Medical Applications (FIGS. 25-30)

This embodiment of the residential pneumatic system concerns using pneumatics to give relief to suffers of sleep apnea, which is a disorder large numbers of people suffer from. To neutralize the effects of this condition many now use a machine that creates a continuous positive airway pressure, called a CPAP machine. A CPAP machine forces air at relatively low pressure into the sleeping persons face to keep nasal passages open. Because many people open the mouth while sleeping the mask must either cover the nose and mouth or cover the nose and use a chin strap to hold the mouth shut. The former is claustrophobic, and the latter is ineffective. Countless mask designs exist. They are all uncomfortable because all use strong elastic straps to hold the equipment in place. The chin strap slides off because it is just elastic fabric. The chin strap is also pretensioned to hold the jaw shut even when the mouth is closed.

Figure 25:
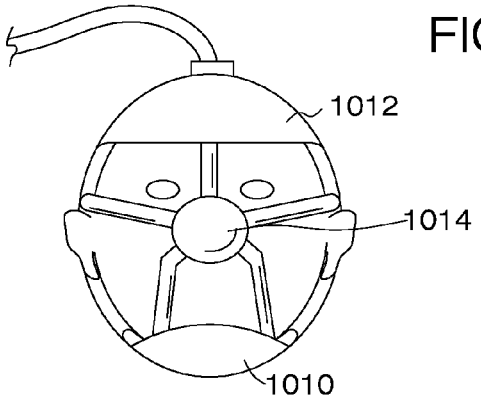
Figure 25A:
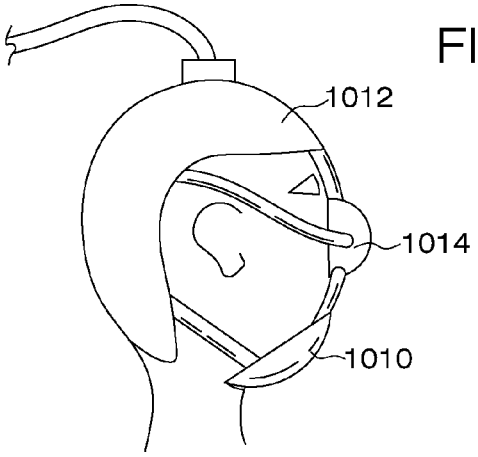
Figure 28:
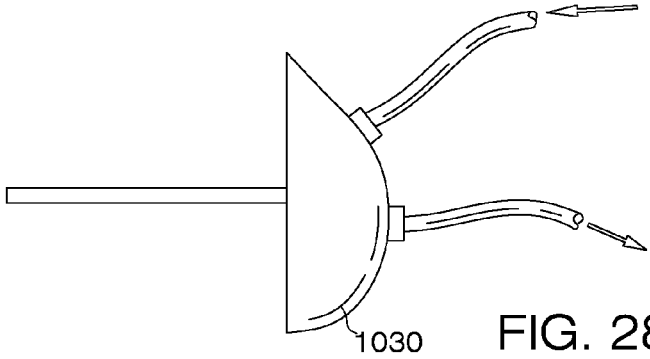

A proposed solution is shown in FIG. 25. There is a semi rigid chin cup 1010. It would be a semi rigid plastic on the outside and cushioned on the inside. There is also a skull 1012 cap to serve as a place to anchor the straps but most important it spreads the pull of straps. There is a mask 1014 that goes over the nose and is held in place by two non-tensioned plastic straps down to the chin cup. Two non-tensioned straps from the sides of the mask over the ears to the skull cap. A fifth strap going from the top of the mask straight up to the skull cap.

There are two non-tensioned plastic straps from each end of the chin cup 1010 back to the skull cap 1012 passing under the ears.

Finally, the air supply is plugged into any CPAP machine on the market or a dedicated wall outlet and brings a small diameter hose 1016 in at the top of skull cap 1012 and then down over the forehead attached to a central strap and into the nose mask 1014. Thus, the CPAP mask of the present invention does not use elastic straps. Instead the the CPAP mask uses a semi ridged (or ridged) chin strap formed in the shape of the lower jaw. It also uses a solid head fabric as a center for distribution of all loads, referenced to herein generally as a skull cap.

The present invention advantageously uses an arrangement of straps connecting nose mask 1014, chin cup 1010 and skull cap 1012 in a direct manner that does not pass over or interfere with the mouth, eyes and ears. The CPAP mask of the present invention is fastened in place with Velcro or press snaps that allow the CPAP mask to be rapidly removed if necessary.

The residential pneumatic system of the present invention also be used as a cardio pulmonary resuscitation device. Men and Women of all ages can experience a traumatic event with drowning, shock, diabetic coma, sudden cardiac arrest or a heart attack resulting in cardiac arrest at any age and any place. It can be at home, at work, while shopping or traveling. It can occur for many reasons, drowning, electric shock, or smoke inhalation.

As is known in the art, the solution is a defibrillator. These are increasingly available at work, shopping centers, and on public transportation. However, sometimes a defibrillator does not succeed in restoring a heart beat.

Artificial respiration is an additional technique to help revive a person. This has many disadvantages. One is that the air going into the patient's lungs is depleted air. The air has just been in the other person's lungs, so it is used up air. Another is that it is hard for a person to get enough volume and pressure on the air provided. Another is that this respiration effort is meaningless if blood is not circulating through the lungs.

The solution offered by the present invention is a pneumatic cardio pulmonary resuscitation attendant [PCPRA] (FIG. 26). The wrap 1018 includes portions that go around the back 1020 and upper chest 1022, the lower rib cage 1024 and breast bone, both lower legs 1026 (calves), both upper legs 1028 (thighs) and arms. There is also a breathing mask, a wrist sensor to read temperature, pulse, oxygen level and blood pressure differential between Dystollic and Systollic. The differential is the significant number. There is a defibrillator 1032 built into the chest wrap. Air chambers 1042 are also included throughout the wrap 1018 and along the legs. These chambers are connected to corresponding valves and an air supply or vacuum for the purpose of promoting blood flow to the heart (note FIGS. 27 and 27*a*).

The wrap 1018 is designed for fast and easy placement on the victim. The victim is rolled onto the side. The back of the vest is somewhat rigid. It is held in place while the patient is rolled back on the back. On one side of the front of the vest are slotted openings 1034 (note FIG. 30). On the outside is a strip of Velcro 1036 at each slot. Inside the slot is a magnetic strip 1038. On the other side of the front of the vest are corresponding straps with flat metal catches 1040. The metal catch is magnetic and has a Velcro end. When the catch is pushed into the slot it stays magnetically and the velcro holds it securely. There are many ways to accomplish the same result (FIG. 30).

If a person collapses at home, anyone present needs to be able to use the PCPRA provided the home is equipped with a residential pneumatic system. The aid provider gets a PCPRA (preferably fitted for the victim), inserts the hose and power apparatus into the nearest wall outlet of the pneumatic residential system. The PCPRA wrap will identify the victim to the residential pneumatic system (RPS) software. The RPS should have a medical file on the patient telling it things such as the patient's usual blood pressure, temperature, pulse, oxygen levels, rate of heart beat and general medical conditions.

The instant the body wrap is completely installed the RPS begins to force blood circulation. Moderate pressure air quickly forces blood down the outside arteries of the leg, back up the inside veins of the leg, up to the chest where the upper heart is compresses forcing blood into the lower heart chambers and out into the lungs, brain, and rest of the body (See FIG. 27).

The RPS also forces lightly pressurized fresh clean air into the lungs, then switches to a light negative pressure (slightly less than atmospheric pressure).

This draws the air back out of the lungs and helps the lungs release the used oxygen. Pressure relief valves in the lines prevent excessive high or low pressures that could exceed lung capacity.

At precisely the correct time in the cycle, the RPS will activate the defibrillator so that it fires when the PCPRA is forcing the heart to pump. The PCPRA may pulsate at a rate of 40 to 60 RPM until it senses a slight heart beat, then it will pump in sync with the slight heart beat.

In FIG. 27 there are several air pockets. The entire PCPRA is divided into air pockets 1042. There are two ways to control the air pressure so it moves up or down the leg or applies pressure to the chest PCPRA in the correct areas to force the heart to move blood through the heart, lungs, brain, and entire body.

One way is to place an air inlet and air pressure overflow on each packet. When a packet reaches a predetermined pressure the pressure overflow lets air flow into the next packet and so on. The disadvantage is the air pressure is predetermined by design so therefore it cannot be increased or decreased, also it does not allow for some packets to be inflated to a higher pressure. So an alternative is to provide air supply to each packet in the wrap.

In the first instance, when air pressure is sucked back out, it has to go back to the first packet. In the second instance each packet individually is quickly inflated and quickly deflated by a valve that rapidly switches in sync. The individual control valves are synchronized by RPS.

Once the blood is circulating and the lungs are receiving oxygen and electric stimulus the next step is medication. Plavix prevents blood cells from sticking together, Warfarin makes blood thinner, Nitrates make arteries expand, other drugs stimulate the heart and some drugs break up clots. Other drugs such as adrenaline may be in the mix.

In a lifeless body drugs are useless. Furthermore, once the heart has used up whatever oxygen is remaining in the blood and heart muscle a defibrillator is of no further use. As soon as the heart stops, everything starts to die. Depleted blood cells, near the end of their own life cycle will die first. The blood has no oxygen and is overloaded with waste. Arteries and veins shrink since there is now no pressure, blood and other enzyme production stops, fluids in the body coagulate blocking the arteries and veins. Soon it is impossible to restart the heart. It cannot push the huge load now needed to restart.

This is why, as soon as blood flow is restored the person performing the rescue will go to the refrigerator and get a needle filled several medications (See FIG. 29). The syringe is divided into several compartments. As the plunger goes in, all medications are released simultaneously. The medicine will not likely all go into one location. The medicine needs to be disbursed at several locations over the entire body. Once blood is moving and there is oxygen again the heart has a much better chance of starting back up. It has lots of oxygen, it has support, the blood is thinner. If a clot caused the heart attack the drugs might dissolve it or the dilated vessels may change into a partial blockage.

If all else fails, the pressure wrap may increase its pressures and beating to otherwise dangerous levels for the purpose of increasing pressure to force arteries to open larger and put more pressure against a clot.

Once the body stops functioning the blood and fluid temperatures can drop quickly. At cooler temperatures the blood gets thicker, cholesterol and fats in the body can start to solidify. Therefore, the body wrap should have resistance heating in its linings to keep the patient warm. Temperatures should likely be well above normal body temperatures because temperatures inside cells are likely to be much higher than body temperatures.

The objective of this invention is to provide a systematic procedure; to revive a patient that cannot be revived by current methods, to maintain the heart, lungs, brain and other organs and cells of a patient whose heart has stopped beating until professional trained help arrives, to force an otherwise non-functioning body to continue to circulate blood, to maintain a viable body, to preserve brain function and body organs until whatever event that caused the condition can be identified, located and neutralized so that self-sustaining life can be restored, to preserve the heart, kidneys, liver, eyes, etc. of the patient so that in the event the patient just cannot be revived and is a card carrying transplant donor, then the organs will be preserved. The PCPRA might also be used by a person who feels a heart attack in progress, knows it, and begins PCPRA treatment before the heart stops. This might stop the heart attack and reverse it.

The pneumatic wrap (PRPCA) was originally intended as another function of the residential pneumatic system. However, as it has been further defined, it might be of benefit for ambulances and paramedics to have on board. It may be useful in hospitals, shopping malls, offices, and public places.

In a residential environment it is not as costly to deploy because the air pumps, controls, infrastructure and software in a computer are already in place for other functions.

After a patient is revived there should be a post recovery follow-up. An artificial heart pump may be inserted inline to assist a still weak pumping heart. Defunct blood cells may need to be removed from the blood, as much as 30% to 50% of blood platelets may be non-functioning or impaired. A blood transplant may be needed to replace these blood cells. A thermographic image of the patient may be used to find pockets where circulation has not been restored which may cause another heart attack if not treated or removed.

A part of this disclosure is a simulator for training people to use this PRPCA. Time is of the essence. A simulated patient can have sensors to monitor how quickly the wrap is installed, the medications applied, all the procedures followed and software to report how well the simulation went.

Thus, the invention relates to a pneumatic wrap designed with the purpose of restoring life function or preserving life viability in a patient whose heart has stopped functioning or has nearly stopped functioning.

The invention also relates to a Pneumatic Wrap with pockets that inflate in serial order as pressure pops over from an adjacent pocket, inflates and deflates in sync with the heart and lungs.

The invention further relates to a pneumatic wrap with pockets that can inflate in parallel with individual maximum and minimum pressure controls. The wrap of the present invention can also be connected to valves that rapidly inflate and deflate in sync with heart and lungs. The wrap of the present invention also works in sync with a forced air mask capable for quickly filling the lungs, applying slightly greater pressure to force oxygen across lung linings and can reverse to suck the air back out at slightly lower than atmospheric pressure.

The mask described above can also have pop off pressure sensors and switches to assure that air pressure into and out of the lungs do not exceed biological limits.

The present invention also relates to a wrap of in conjunction with sensors to measure real time conditions in the patient to transmit back to the RPS so the RPSD can adjust its actions accordingly. The sensors already exist, but I am combining them into one piece of equipment, already attached to a part of the wrap so it can be easily found and quickly placed on the patient. It is already wired through the wrap back into the wall connection.

The present invention further relates to the above described wrap with a built in defibrillator to provide precisely timed shocks to the heart and perhaps lower electrical stimulants depending on the treatment cycle.

The invention further relates to a wrap and a multi-medicine syringe for injecting many viral medicines simultaneously into multiple locations on the patient, perhaps 6 to 8, to get quick distribution throughout the patient.

The wrap can also have rapid fasteners using a magnet to prevent slipping out during the excitement and the velcro to hold the wrap in place once the snaps are put in place.

The wrap can alternatively employ a resistance wire heating embedded in the lining to both preserve and force heat to flow into the patient.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A pneumatic system for use in a residence with a plurality of rooms, the system comprising in combination:

a plurality of interconnected supply ports, the supply ports functioning to collecting air at various locations within the residence, at least one of the supply ports serving to ventilate a room in the residence and at least one of the supply ports serving to supply the suction for a central vacuum system;

a first fluid circuit for collecting the air gathered by the supply ports;

a suction pump operatively interconnected to the first fluid circuit and functioning to draw suction at each of the supply ports, a dehumidifier and electronic air filter associated with the suction pump and functioning to clean and dehumidify the air collected at the supply ports, the outlet of the suction pump being operatively connected to the input of a heating ventilating and air conditioning (HVAC) system;

a compressor operatively connected to an output of the pump by way of an air duct, the compressor functioning to compress the air from the suction pump to approximately 100 pounds per square inch;

a pneumatic manifold operatively connected to the output of the compressor;

a second fluid circuit operatively connected to the output the manifold and functioning to deliver pressurized air to various locations within the residence;

a third fluid circuit positioned between the first and second fluid circuits and operatively connected to the air duct, the third fluid circuit functioning to deliver a source of low pressure air to various locations within the residence.

2. A pneumatic system for use within a residence, the system comprising in combination:

a plurality of interconnected supply ports, the supply ports functioning to collecting air from various locations within the residence, at least one of the supply ports serving to ventilate a room;

a first fluid circuit for collecting the air gathered by the supply ports;

a suction pump operatively interconnected to the first fluid circuit and functioning to draw suction at each of the supply ports, a compressor operative connected to an output of the pump for generating a supply of pressurized air;

a second fluid circuit operatively connected to the output of the compressor and functioning to deliver high pressure air as needed to various locations within the residence;

a third fluid circuit operatively connected between the suction pump and the compressor and functioning to deliver low pressure air as needed to various locations within the residence.

3. The system as described in claim 2 wherein a dehumidifier and an electronic air filter are associated with the suction pump and which functioning to clean and dehumidify the air collected at the supply ports.

4. The system as described in claim 2 wherein at least one of the supply ports is used in connection with a central vacuum system.

5. The system as described in claim 2 wherein an output of the pump is delivered to a conventional heating ventilating and air conditioning system.

6. The system as described in claim 2 wherein the pressurized air is used to power a garage door opener.

7. The system as described in claim 2 wherein the pressurized air is supplied to the interior of a piece of furniture to thereby create a comfort zone for an individual.

8. The system as described in claim 2 wherein the pressurized air is used to clean a sink.

9. A residential pneumatic system comprising in combination:

a plurality of interconnected supply ports, the supply ports functioning to collecting air, at least one of the supply ports serving to ventilate a room;

a first fluid circuit for collecting the air gathered by the supply ports;

a suction pump operatively interconnected to the first fluid circuit and functioning to draw suction at each of the supply ports;

a compressor operative connected to an output of the pump for generating a supply of pressurized air;

a second fluid circuit for distributing pressurized air created by the compressor;

wherein second fluid circuit delivers air to a motor and wherein the motor powers a residential appliance a third fluid circuit positioned between the suction pump and compressor for distributing non-pressurized air gathered by the suction pump.

* * * * *